US005116656A

United States Patent [19]

Morris et al.

[11] Patent Number: 5,116,656

[45] Date of Patent: May 26, 1992

[54] USE OF METHYL ABIETATES FOR TRANSFER OF PERFUMING COMPOSITIONS DURING FABRIC DRYING

[75] Inventors: Anthony F. Morris, Gingins; Sina D. Escher, Confignon, both of Switzerland

[73] Assignee: Firmenich SA, Geneva, Switzerland

[21] Appl. No.: 513,633

[22] Filed: Apr. 24, 1990

[30] Foreign Application Priority Data

Apr. 27, 1989 [CH] Switzerland ..... 1606/89

[51] Int. Cl.[5] ..... D06B 13/00; B32B 3/10

[52] U.S. Cl. ..... 428/131; 428/245; 428/264; 428/290; 428/536; 428/913; 252/8.6; 34/9; 34/12; 427/242; 512/2

[58] Field of Search ..... 428/131, 245, 264, 290, 428/536, 913; 252/8.6; 34/9, 12; 427/242; 512/2

[56] References Cited

U.S. PATENT DOCUMENTS

| | | | |
|---|---|---|---|
| 3,686,025 | 11/1972 | Morton | 117/140 R |
| 3,956,556 | 5/1976 | McQueary | 428/131 |
| 4,073,996 | 2/1978 | Bedenk et al. | 428/274 |
| 4,134,838 | 1/1979 | Hooper et al. | 512/1 X |
| 4,237,155 | 12/1980 | Kardouche | 427/242 |
| 4,584,127 | 4/1986 | Uijttewaal et al. | 512/8 |
| 4,652,401 | 3/1987 | Schaper et al. | 512/21 |
| 4,701,278 | 10/1987 | Fehr | 252/8.6 X |
| 4,808,086 | 2/1989 | Evans et al. | 427/242 |
| 4,818,556 | 4/1989 | Hoashi | 426/615 |

FOREIGN PATENT DOCUMENTS 2731318 2/1979 Fed. Rep. of Germany .

OTHER PUBLICATIONS

Food and Cosmetics Toxicology, vol. 12 (1974) pp. 931 and 939, Opdyke Monographs on Fragrance Raw Materials, Res. Inst. Fragrance Mat., Inc., Englewood Cliffs, N.J.

*Primary Examiner*—Ellis P. Robinson
*Assistant Examiner*—William P. Watkins, III
*Attorney, Agent, or Firm*—Pennie & Edmonds

[57] ABSTRACT

A process and article for enhancing the efficiency of transfer of a perfuming composition between a flexible porous or fibrous element and a fabric during drying of the fabric by incorporating a mixture of methyl abietates, preferably those available under the tradename ABALYN ® or HERCOLYN ®, with the perfuming composition and at least one fabric conditioning agent which are carried by the flexible porous or fibrous element.

18 Claims, No Drawings

USE OF METHYL ABIETATES FOR TRANSFER OF PERFUMING COMPOSITIONS DURING FABRIC DRYING

BRIEF SUMMARY OF THE INVENTION

One object of the present invention is to provide a process to enhance the efficiency of the transfer of a perfuming composition between a flexible porous or fibrous element and a cotton fabric, so as to increase the amount of said perfuming composition which is deposited on said cotton fabric when the latter is dried in a tumbler in the presence of said flexible porous or fibrous element, said perfuming composition being carried on said flexible porous or fibrous element together with at least one fabric conditioning agent, which process comprises adding to said perfuming composition a mixture of methyl abietates of formula

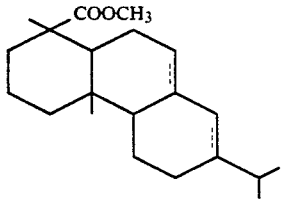

(I)

which can have one or two double bonds in the positions indicated by the dotted lines, and at least one active perfuming ingredient of formula

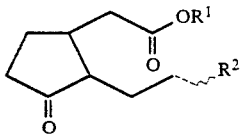

(II)

which can have a double bond in the position indicated by the dotted line and wherein the wavy line defines a C—C bond of E or Z configuration when the bond indicated by the dotted line is a double bond, and symbols $R^1$ and $R^2$ can be identical or different and stand each for a lower alkyl radical from $C_1$ to $C_3$.

Another object of the present invention is to provide a flexible porous or fibrous element carrying a perfuming composition and at least one fabric conditioning agent, said perfuming composition containing a mixture of methyl abietates of formula (I) in admixture with at least one perfuming ingredient of formula (II).

BACKGROUND OF THE INVENTION

A number of prior art publications describe the advantages associated with the use of fabric conditioning articles during the drying-up of fabrics or textiles rather than during their washing-up. These fabric conditioners intended for use in a clothes' dryer consist generally of an absorbent carrier element or substrate bearing at least one fabric conditioning agent, the latter acting as a softener, perfuming ingredient, anti-shrinking agent, bactericide or other. Amongst these publications, one can cite U.S. Pat. Nos. 3,686,025, 3,956,556, 4,073,996, 4,237,155, 4,808,086 and 4,818,556, which are here included by reference. For example, U.S. Pat. No. 4,073,996, to Bedenk and Sagel, describes an article of the type above-mentioned consisting essentially of a substrate carrying a mixture of an organic softening agent with a smectite clay. Bedenk and Sagel also cite, in a detailed manner, other types of additives that can be incorporated into the said mixture, namely perfuming ingredients. However, the cited authors also remark that it is very difficult to obtain an optimum transfer of the perfuming composition carried by the substrate from the latter to the fabric treated during its drying-up, mainly as a result of the problems related to the often weak substantivity of the fabric and the high volatility of most of the perfuming ingredients preferred for this type of application. They further observe that the presence of smectite clay in the mixture which is carried by the conditioning article according to their invention makes it possible to improve said transfer of the perfuming ingredient, as compared to prior known fabric conditioning articles.

We have now discovered that the amount of perfuming composition that can be transferred from a substrate such as that described in U.S. Pat. No. 4,073,996 into a cotton fabric, when the latter is dried under the conditions described before, can be distinctly increased if a particular perfuming ingredient is used in said composition, combined with a mixture of methyl abietates.

Methyl abietates are the methyl esters of abietic acid, which are represented by the formula

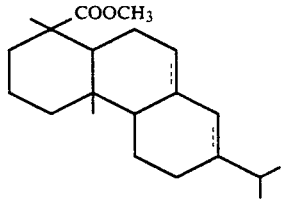

(I)

which can have one or two double bonds in the positions indicated by the dotted lines. These compounds are well known and used in the perfume industry as fixatives [see S. Arctander, Perfume and Flavor Chemicals, refs. 1570 and 1892, S. Arctander, Montclair, N.J., USA]. It could have been expected, therefore, that their combined use with a perfuming ingredient in a composition carried by a substrate, consisting of a flexible porous or fibrous element and adapted to the conditioning of fabrics during the drying-up of the latter, might have rendered the transfer of said composition between the substrate and the cotton fabric less efficient and reduced the amount of perfuming composition deposited on said cotton fabric, when compared to the transfer process of a perfuming composition free of methyl abietates. However, it is exactly the contrary that we observe, i.e., the presence of methyl abietates in the perfuming composition clearly favors the transfer of the latter.

THE INVENTION

It is an object of the present invention to provide a process to enhance the efficiency of the transfer of a perfuming composition between a flexible porous or fibrous element and a cotton fabric, so as to increase the amount of said perfuming composition which is deposited on said cotton fabric when the latter is dried in a tumbler in the presence of said flexible porous or fibrous element, said perfuming composition being carried on said flexible porous or fibrous element together with at least one fabric conditioning agent, which process comprises adding to said perfuming composition a mixture of methyl abietates of formula

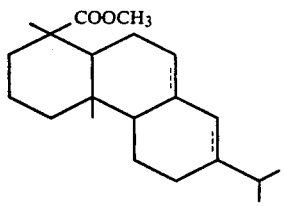

(I)

which can have one or two double bonds in the positions indicated by the dotted lines, and at least one active perfuming ingredient of formula

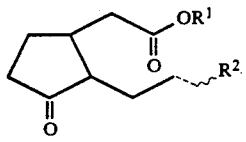

(II)

which can have a double bond in the position indicated by the dotted line and wherein the wavy line defines a C—C bond of E or Z configuration when the bond indicated by the dotted line is a double bond, and symbols $R^1$ and $R^2$ can be identical or different and stand each for a lower alkyl radical from $C_1$ to $C_3$.

A mixture of methyl abietates means here a mixture of two or more compounds of formula (I). For practical reasons, it is preferred to use a mixture of such esters of the type available on the market under the designation of ABALYN or HERCOLYN ® D (origin: Hercules Powder Co., USA).

According to a preferred embodiment of the invention, the perfuming ingredient of formula (II) used in the composition is methyl-3-oxo-2-pentylcyclopentane, also designated as methyl dihydrojasmonate, and known commercially under the tradename of HEDIONE ® (origin: Firmenich SA, Geneva).

The flexible porous or fibrous element used in the process of the invention, and which is another object thereof, can be any element formed of any material capable of absorbing the said perfuming composition and fabric conditioning agent, and capable of freeing these two agents during the drying of the cotton fabrics in the presence of said element. Thus, one can cite as materials which are convenient for this purpose paper and natural or synthetic fabrics, whether they are woven or not. The interested reader is referred to the U.S. patents cited before for a detailed discussion of the materials adapted to form the flexible porous substrate used as a means for carrying out the process of the instant invention and which is also an object of this invention.

According to a preferred embodiment, the flexible porous or fibrous element is formed of a fiber sheet (regenerated cellulose) provided with perforations which prevent the blocking of the air outlet system of the tumbler or clothes dryer where the drying operation of the cotton fabrics takes place, in the presence of said element. U.S. Pat. No. 3,944,694 describes a fabric conditioning article comprising an element of this type, and the relevant disclosures of said patent are here included by reference.

Preferably, as the fabric conditioning agent carried on this substrate, one will use a softening agent of the non-ionic or cationic type, or a mixture of both types of softeners. Other additives can, of course, also be used, such as fumigants, lubricants, fungicides and anti-shrinking agents. The U.S. patents already cited, included here by reference, describe in greater detail all the types of additives that can be used as the fabric conditioning agent of the present invention.

According to the instant invention, the perfuming composition which contains a mixture of methyl abietates of formula (I) and at least one compound of formula (II) as the active perfuming ingredient can be set on the flexible porous or fibrous element, for instance, by impregnation. Preferably, one will use an element which has previously been prepared to be employed as the fabric conditioning article during the drying of the textiles in a closed heated space, i.e., an element which already carries the conditioning agent or agents. A great number of such articles are available on the market and one can cite, namely, the woven materials commercialized by Procter & Gamble (Cincinnati, Ohio, USA) under the tradename of BOUNCE and which are described in the above-mentioned U.S. patents.

It goes without saying that the perfuming composition may contain one or more compounds of formula (I) as active ingredients, either pure or dissolved in solvents of current use in perfumery, or yet in admixture with other perfuming ingredients currently used. The latter may be of natural or synthetic origin and of varied nature. One can cite, by way of example, those ingredients described by S. Arctander in "Perfume and Flavor Chemicals", Montclair, N.J., USA. A more detailed description of said ingredients is not warranted here since the man in the art is able to choose these ingredients as a function of the perfuming effect he wants to achieve.

The instant invention will now be described in greater detail by way of the following example. However, the latter, must not be interpreted as being restrictive of the invention. In particular, it goes without saying that all the embodiments of the invention which may result from a combination of the present disclosure with the disclosures of the cited U.S. patents, included here by reference, must be considered as embodiments of the instant invention which the man in the art is able to carry out without any further inventive effort and which fall within the scope of the claims here attached. Such embodiments include for example those resulting from the use of the different types of materials described and which are convenient to form the flexible porous or fibrous element according to the invention, from the use of one or more conditioning agents of the types already cited and from the possibility that these agents may be set on said element either by impregnation or simply deposited on it as a superficial layer.

EXAMPLE

Two solutions, A and B, were prepared by admixture of the following ingredients:

| Ingredient (% by weight) | Solution A | Solution B |
|---|---|---|
| HEDIONE ®* | 80 | 80 |
| HERCOLYN ® D** | 20 | — |
| Benzyl benzoate | — | 20 |

*methyl-3-oxo-2-pentylcyclopentane acetate; origin: Firmenich SA, Geneva
**mixture of hydrogenated methyl esters of rosinic acids; origin: Hercules Powder Co., U.S.A.

Two sheets of "BOUNCE unscented" (commercial product from Procter & Gamble, USA) were then impregnated with 1 ml of solution A, respectively solution B. These two sheets were then stored for at least 24 h, each having been previously wrapped in an aluminum sheet.

Two large cotton bath towels, weighing each approximately 450 g, and commercially available, were washed in separate washing machines with an unscented powder detergent, rinsed and wringed in exactly the same washing-cycle conditions. They were then dried in separate spin-dryers or tumblers, under standard temperature conditions and for an identical period of time, in the presence of one of the BOUNCE sheets previously prepared as described above and carrying solution A, respectively solution B.

Once dried, the two treated cotton towels were immediately evaluated for comparison of their odor intensity by a panel of eight expert perfumers on a blind test. Seven out of the eight perfumers chose the cotton towel which had been dried in the presence of the BOUNCE sheet carrying solution A, having judged that the odor of this cotton towel was distinctly stronger than the odor of the cotton towel dried in the presence of the BOUNCE sheet impregnated with solution B. The eighth perfumer preferred this latter cotton towel for the quality of the odor note that it developed.

The results of this test showed that the quantity of HEDIONE® transferred from the BOUNCE sheet into the cotton towel is larger when said sheet is impregnated with the mixture of HEDIONE® and HERCOLYN®D. No such effect is observed when HEDIONE® is combined with another well-known fixative, i.e., benzyl benzoate.

Similar results were obtained, for example, when a perfuming composition was used which contained HEDIONE® and yet another fixative, that is, benzyl salicylate, in the same relative concentrations as those of solutions A and B. Once again, the cotton towel which had been treated with the BOUNCE sheet carrying solution A had a much stronger odor than that treated with the BOUNCE sheet impregnated with the mixture of HEDIONE® and benzyl salicylate.

Furthermore, comparative tests of the same type of those described were also carried out with perfuming compositions which contained HEDIONE® in admixture with other perfuming co-ingredients and with one of the fixatives above-mentioned. Every time, the cotton fabric which had been dried in the presence of a BOUNCE sheet impregnated with the composition containing HERCOLYN® D as a fixative gave out a stronger smell than any of the other cotton fabrics which had been dried under similar conditions but in the presence of BOUNCE sheets impregnated with compositions containing other fixatives than methyl abietates.

What we claim is:

1. A process to enhance the efficiency of transfer of a perfuming composition between a flexible porous or fibrous element and a fabric to increase the amount of said perfuming composition which is deposited on said fabric when the latter is dried in a tumbler in the presence of said flexible porous or fibrous element, said perfuming composition being carried on said flexible porous or fibrous element together with at least one fabric conditioning agent, which process comprises adding to said perfuming composition a mixture of methyl abietates of formula

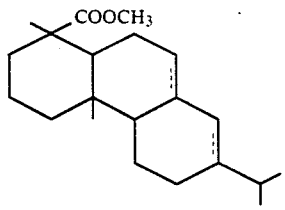

(I)

which can have one or two double bonds in the positions indicated by the dotted lines, and at least one active perfuming ingredient of formula

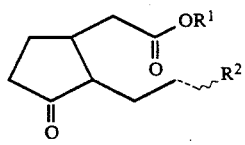

(II)

which can have a double bond in the position indicated by the dotted line and wherein the wavy line defines a C—C bond of E or Z configuration when the bond indicated by the dotted line is a double bond, and symbols $R^1$ and $R^2$ can be identical or different and stand each for a lower alkyl radical from C1 to C3 in an amount sufficient to enhance the efficiency of transfer of said perfuming composition to the fabric when the element and fabric are dried.

2. A process according to claim 1, wherein the compound of formula (II) is methyl-3-oxo-2-pentylcyclopentane acetate.

3. A process according to claim 1, wherein said perfuming ingredient is in admixture with other perfuming co-ingredients.

4. A process according to claim 1, wherein said flexible porous or fibrous element is made of a regenerated cellulose sheet equipped with perforations.

5. A process according to claim 1, wherein said fabric conditioning agent is a softening agent.

6. A process according to claim 5, wherein said softening agent is of the non-ionic or cationic type, or a mixture of softening agents of both these types.

7. A flexible porous or fibrous element carrying a perfuming composition and at least one fabric conditioning agent, said perfuming composition containing a mixture of methyl abietates of formula

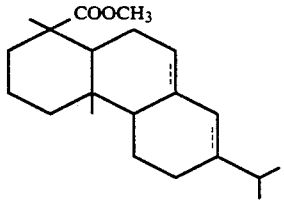

(I)

which can have one or two double bonds in the positions indicated by the dotted lines, in admixture with at least one perfuming ingredient of formula

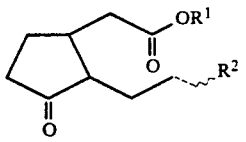

(II)

which can have a double bond in the position indicated by the dotted line and wherein the wavy line defines a C—C bond of E or Z configuration when the bond indicated by the dotted line is a double bond, and symbols $R^1$ and $R^2$ can be identical or different and stand each for a lower alkyl radical from C1 to C3 in an amount sufficient to enhance the efficiency of transfer of said perfuming composition to the fabric when the element and fabric are dried.

8. An element according to claim 7, wherein the compound of formula (II) is methyl-3-oxo-2-pentylcyclopentane acetate.

9. An element according to claim 7, wherein said perfuming ingredient is in admixture with other perfuming co-ingredients.

10. An element according to claim 7, wherein said flexible porous or fibrous element is made of a regenerated cellulose sheet equipped with perforations.

11. An element according to claim 7, wherein said fabric conditioning agent is a softening agent.

12. An element according to claim 11, wherein said softening agent is of the non-ionic or cationic type, or a mixture of softening agents of both these types.

13. A process to enhance the efficiency of transfer of a perfuming composition between a flexible porous or fibrous element and a fabric during drying of the fabric, which process comprises:

applying to a flexible porous or fibrous element which contains at least one fabric conditioner a perfuming composition comprising a mixture of methyl abietates of formula

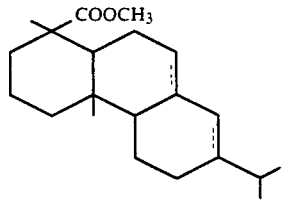

(I)

which can have one or two double bonds in the positions indicated by the dotted lines, in admixture with at least one perfuming ingredient of formula

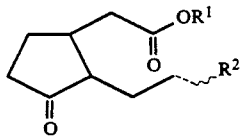

(II)

which can have a double bond in the position indicated by the dotted line and wherein the wavy line defines a C—C bond of E or Z configuration when the bond indicated by the dotted line is a double bond, and symbols $R^1$ and $R^2$ can be indentical or different and stand each for a lower alkyl radical from $C_1$ to $C_3$; and drying a fabric in the presence of said flexible porous or fibrous element to increase the amount of said perfume composition which is deposited on said fabric compared to that deposited from an element which does not contain the methyl abietates.

14. A process according to claim 13, wherein the compound of formula (II) is methyl-3-oxo-2-pentylcyclopentane acetate.

15. A process according to claim 13, wherein said perfuming ingredient is in admixture with other perfuming co-ingredients.

16. A process according to claim 13, wherein said flexible porous or fibrous element is made of a regenerated cellulose sheet equipped with perforations.

17. A process according to claim 13, wherein said fabric conditioner is a softening agent.

18. A process according to claim 17, wherein said softening agent is of the non-ionic or cationic type, or a mixture of softening agents of both these types.

* * * * *